US008772654B2

(12) United States Patent
Tziviskos et al.

(10) Patent No.: US 8,772,654 B2
(45) Date of Patent: Jul. 8, 2014

(54) AUDIO JACK THAT ENABLES ELECTRICAL AND OPTICAL CONNECTIVITY

(75) Inventors: George Tziviskos, Cupertino, CA (US); Zheng Gao, San Jose, CA (US)

(73) Assignee: Apple Inc., Cupertino, CA (US)

( * ) Notice: Subject to any disclaimer, the term of this patent is extended or adjusted under 35 U.S.C. 154(b) by 124 days.

(21) Appl. No.: 13/492,808

(22) Filed: Jun. 9, 2012

(65) Prior Publication Data

US 2013/0330962 A1 Dec. 12, 2013

(51) Int. Cl.
*H01R 33/96* (2006.01)

(52) U.S. Cl.
USPC ..... 200/51.09; 439/188

(58) Field of Classification Search
CPC ..... H01R 24/58; H01R 23/26; H01R 13/71; H01R 13/717; H01R 13/7175; H01R 13/703
USPC ..... 200/51.09; 439/668, 188
See application file for complete search history.

(56) References Cited

U.S. PATENT DOCUMENTS 4,937,404 A * 6/1990 Kitagawa ..... 200/51.09
6,056,602 A * 5/2000 Wu ..... 439/668
6,109,797 A 8/2000 Nagura et al.
6,312,274 B1 * 11/2001 Lin ..... 439/188
6,790,095 B2 9/2004 Liu
7,033,226 B1 * 4/2006 Chien et al. ..... 439/668
7,108,529 B1 9/2006 Huang
7,112,099 B2 9/2006 Ma
7,147,497 B1 * 12/2006 Liao ..... 439/188
7,198,504 B2 * 4/2007 Chien et al. ..... 439/385
7,351,113 B2 * 4/2008 Lee et al. ..... 439/668
7,361,062 B2 * 4/2008 Long et al. ..... 439/668
7,371,125 B2 * 5/2008 McHugh et al. ..... 439/668
7,726,990 B2 * 6/2010 Wang et al. ..... 439/188
7,833,032 B1 * 11/2010 Yu ..... 439/188
7,976,347 B2 * 7/2011 Zhang ..... 439/668
8,287,314 B1 * 10/2012 Gao et al. ..... 439/668
8,465,329 B2 * 6/2013 Fields et al. ..... 439/668
2006/0166561 A1 7/2006 Ma
2007/0123111 A1 * 5/2007 Chien et al. ..... 439/668

* cited by examiner

*Primary Examiner* — Vanessa Girardi
(74) *Attorney, Agent, or Firm* — Kilpatrick Townsend & Stockton LLP

(57) ABSTRACT

Circuits, methods, and apparatus that may provide for reliable detection of electrical and optical audio plugs. One example may detect an optical audio plug by employing one or more mechanical detect switches. These switches may include a first contacting portion and a second contacting portion that are separated from each other when an audio plug is inserted into the audio jack. The second contacting portion may include one or more arms to contact a surface portion of the first contacting portion. The first contacting portion and the second contacting portion may be biased such that they tend to stay in contact with each other as the first contacting portion begins to be deflected by the insertion of an audio plug, thereby wiping dust or debris from between the first contacting portion and the second contacting portion.

21 Claims, 9 Drawing Sheets

AUDIO JACK THAT ENABLES ELECTRICAL AND OPTICAL CONNECTIVITY

BACKGROUND

Portable electronic devices, such as portable media players, tablet, netbook, and laptop computers, cell, media, and smart phones, have become ubiquitous in recent years. These devices often include an audio jack through which they receive and provide audio information. The audio jacks may include, or be connected to, electronic circuits such as audio drivers for driving headphones or speakers, audio receivers for receiving audio signals from a microphone, and others. These audio jacks may be arranged to receive an audio plug that may be connected to headphones, speakers, microphones, or other equipment.

These audio plugs may be electrical audio plugs. That is, they may include a number of ring-shaped contacts along their lengths. These contacts may connect to conductors in a cable attached to the audio plug. These contacts may include contacts for left audio, right audio, ground, and microphone. These audio plugs may also be optical audio plugs, that is, they may have an opening at an end to transmit or receive optical signals. In such a situation, the audio plug may be formed of plastic or other nonconductive material. Accordingly, it may be desirable to be able to detect the presence of either electrical or optical audio plugs.

These audio jacks may also include an opening where an audio plug may be inserted by a user. Unfortunately, dust and other debris and particulate matter may enter the opening and foul the inside of an audio jack. This particulate matter may then hamper or impede the proper function of the audio jack.

Also, some electronic devices employing audio jacks may achieve great commercial success. As such, millions of these audio jacks may need to be manufactured. Due to the magnitude of this task, any simplification in the assembly process is multiplied the millions of times the audio jacks are assembled. Accordingly, it may be desirable to provide an audio jack that is readily manufactured.

Thus, what is needed are circuits, methods, and apparatus that may provide audio jacks having reliable detection of both electrical and optical audio plugs. It may also be desirable that these audio jacks be robust and durable, and be readily assembled.

SUMMARY

Accordingly, embodiments of the present invention provide circuits, methods, and apparatus that may provide audio jacks having reliable detection of both electrical and optical audio plugs, may be robust and durable, and may be readily assembled. An illustrative embodiment of the present invention may detect the presence of an audio plug by employing one or more mechanical detect switches. A specific embodiment of the present invention may employ two mechanical detect switches. These mechanical detect switches may include a first contacting portion and a second contacting portion that are separated from each other when an audio plug is inserted into the audio jack. By relying on a physical mechanical separation between the first contacting portion and the second contacting portion, the presence of an audio plug may be detected.

An illustrative embodiment of the present invention may detect an electrical audio plug by employing multiple ground contacts. When a conductive audio plug is inserted into the receptacle, an electrical path between the ground contacts may be formed. This electrical path may be detected and used to determine that an electrical audio plug has been inserted. Also, when combined with mechanical switches, the presence of nonconductive optical audio plugs may be determined. Specifically, when the mechanical detect switches are both open but an electrical path between the ground contacts is not formed, it is known that an audio plug is present, and that it is not an electrical audio plug. The knowledge that an optical audio plug is present may allow the electronic device housing the audio jack to activate a light-emitting diode module when nonconductive optical audio plug is inserted, and otherwise to power down the light-emitting diode module to save power.

Embodiments of the present invention may provide reliable and durable audio jack. In an illustrative embodiment of the present invention, highly reliable and durable mechanical detect switches may be employed. These detect switches may include a first contacting portion and a second contacting portion. The first contacting portion may have a surface portion to contact one or more arms on the second contacting portion. A specific embodiment of the present invention may employ a second contacting portion having two arms to contact the surface portion of the first contacting portion. With this configuration, if dust or other debris enters the audio jack and prevent contact between an arm of the second contacting portion and the surface portion of the first contacting portion, the second arm of the second contacting portion may remain in contact with the surface portion of the first contacting portion. Moreover even if an entire mechanical detect switch is rendered inoperable by such dust or other debris, the second mechanical detect switch may be relied upon. These multiple levels of redundancy may result in a highly reliable audio jack.

Embodiments of the present invention may also provide reliable and durable audio jack by biasing the first contacting portion and the second contacting portion such that they tend to stay in contact with each other as the first contacting portion begins to be deflected by the insertion of an audio plug. That is, as the first contacting portion is deflected by the insertion of an audio plug, the arms of the second contacting portion may tend to stay in contact with the surface portion of the first contacting portion. This contact may lead to a wiping action that may remove dust or debris from between the first contacting portion and the second contacting portion, thereby increasing durability and reliability.

Another illustrative embodiment of the present invention may provide an audio jack that is easy to assemble. A specific embodiment of the present invention may provide a housing for an audio jack, the housing having a central passage to accept an audio plug. The central passage may form an opening in a front of an audio jack, and it may have a rear opening to interface with a light-emitting diode. The central passage may also have openings leading to contact positions in the housing. The contacts may be inserted and covered by a nonconductive cover. The audio jack may also be at least partially shielded.

Embodiments of the present invention may employ the two mechanical detect switches as the left audio channel contacts in the audio jack. In this way, the detect switches may be located in the central passage furthest from the opening in the front of the audio jack. The detect switches may be used to activate an audio signal. In this way, circuitry associated with the audio jack may activate the audio signal only after it detects the insertion of an audio plug, thus avoiding the electrical noise that may occur during the insertion of an audio plug if a signal is present at all times.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
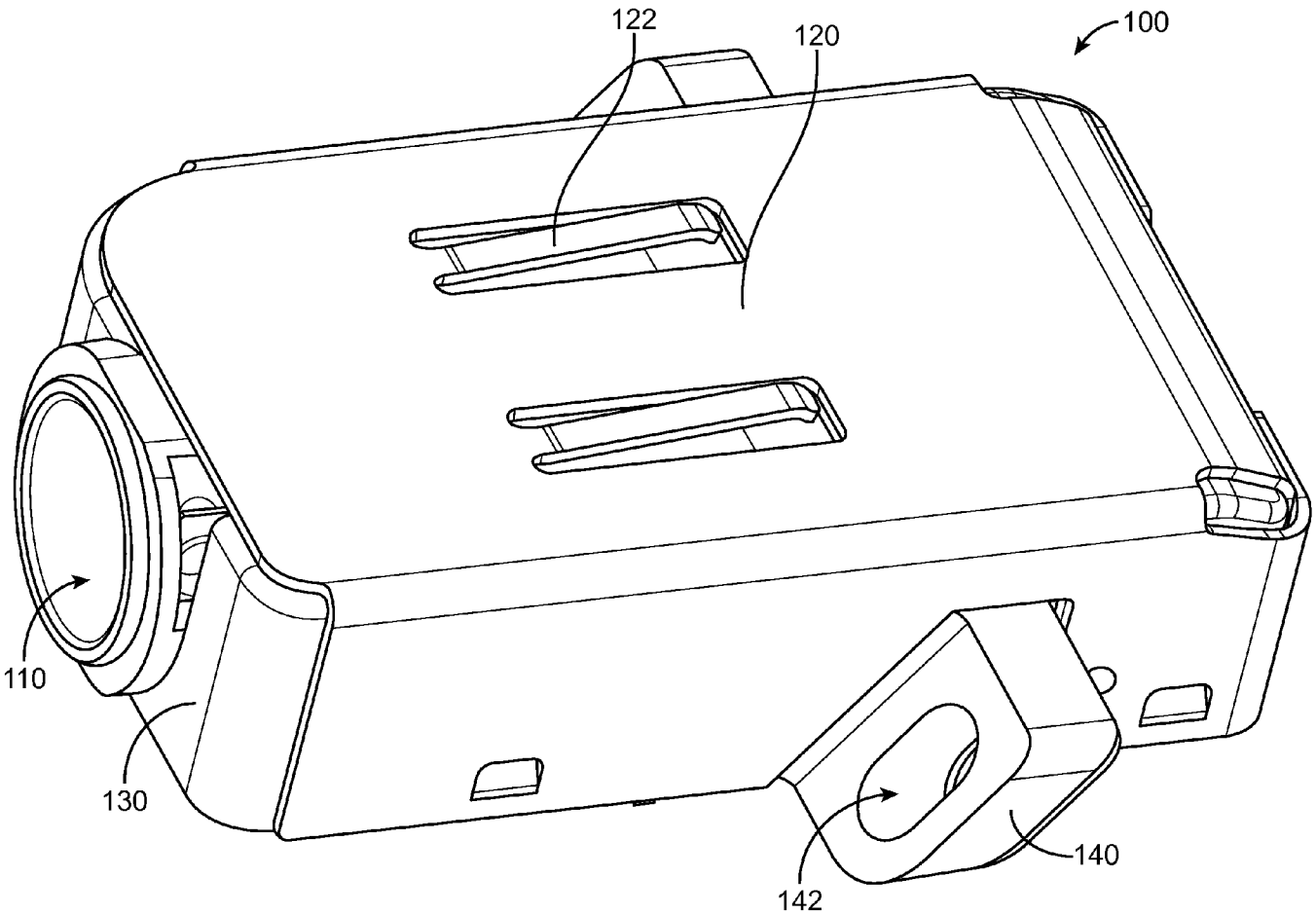
FIG. 1 illustrates a top oblique view of an audio jack according to an embodiment of the present invention.

FIG. 1 illustrates a top oblique view of an audio jack according to an embodiment of the present invention. This figure, as with the other included figures, is shown for illustrative purposes and does not limit either the possible embodiments of the present invention or the claims.

Audio jack 100 may include housing 130 having a passage for an audio plug, the passage forming a front opening 110. Housing 130 may further include one or more flanges 140 having openings 142. Flanges 140 may be used to mount audio jack 100 to a main-logic board, to a frame or bracket on a main-logic board, or to another appropriate substrate. In this example, flanges 140 may be at a non-orthogonal angle. Opening 142 may accept a fastener to secure audio jack 100 to the main-logic board or other appropriate substrate. Housing 130 may be partially or substantially covered with a shell 120. Shell 120 may include one or more fingers 122 for contacting a frame, device enclosure, or portion thereof. Housing 130 may be formed of a plastic, nylon, or other nonconductive material. Shell 120 may be formed of stainless steel, or other conductive material. Shell 120 may provide electrical and EMI shielding around audio jack 100.

Figure 2:
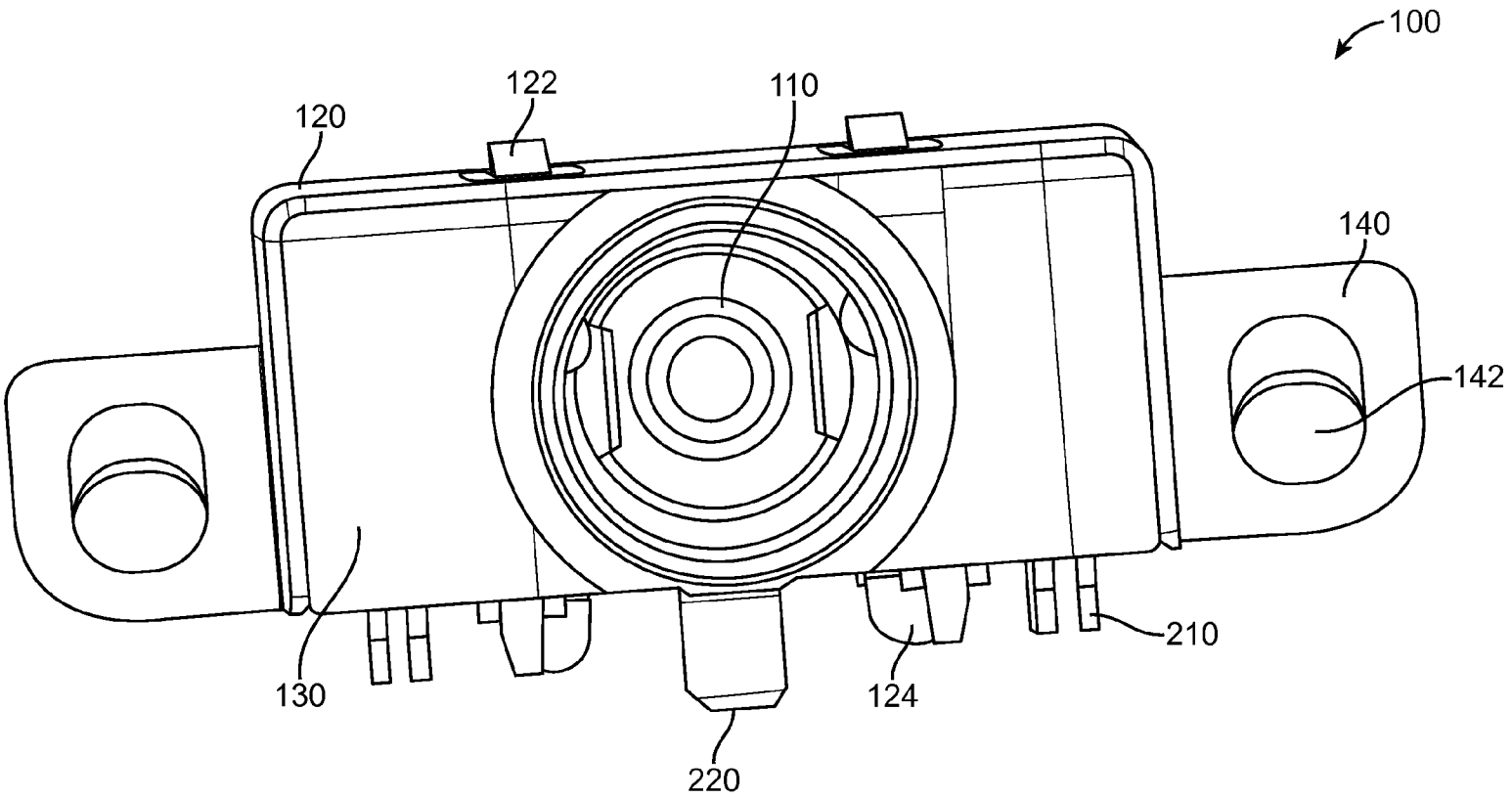
FIG. 2 illustrates a front view of an audio jack according to an embodiment of the present invention.

FIG. 2 illustrates a front view of an audio jack according to an embodiment of the present invention. Audio jack 100 may include housing 130 having a passage to accept an audio plug, the passage forming a front opening 110 in housing 130. Housing 130 may further include flanges 140 having openings 142. Again, flanges 140 may be used to secure audio jack 100 to a main-logic board, to a frame or bracket on a main-logic board, or to another appropriate substrate by a fastener which may pass through opening 142. Housing 130 may include post 220. Post 220 may be aligned with an opening on a main-logic board or other substrate in order to mechanically secure audio jack 100 to the main-logic board. Housing 130 may be partially or substantially covered by shell 120. Shell 120 may include fingers 122 and contacts 124. Fingers 122 may contact a frame, device enclosure, or portion thereof. Tabs 124 may be inserted into openings in the main-logic board or other appropriate substrate and soldered to ground contacts on the board. Through-hole contacts portions 210 may be inserted into contact openings on the main-logic board, where they may be soldered to form connections with traces on the main-logic board.

Figure 3:
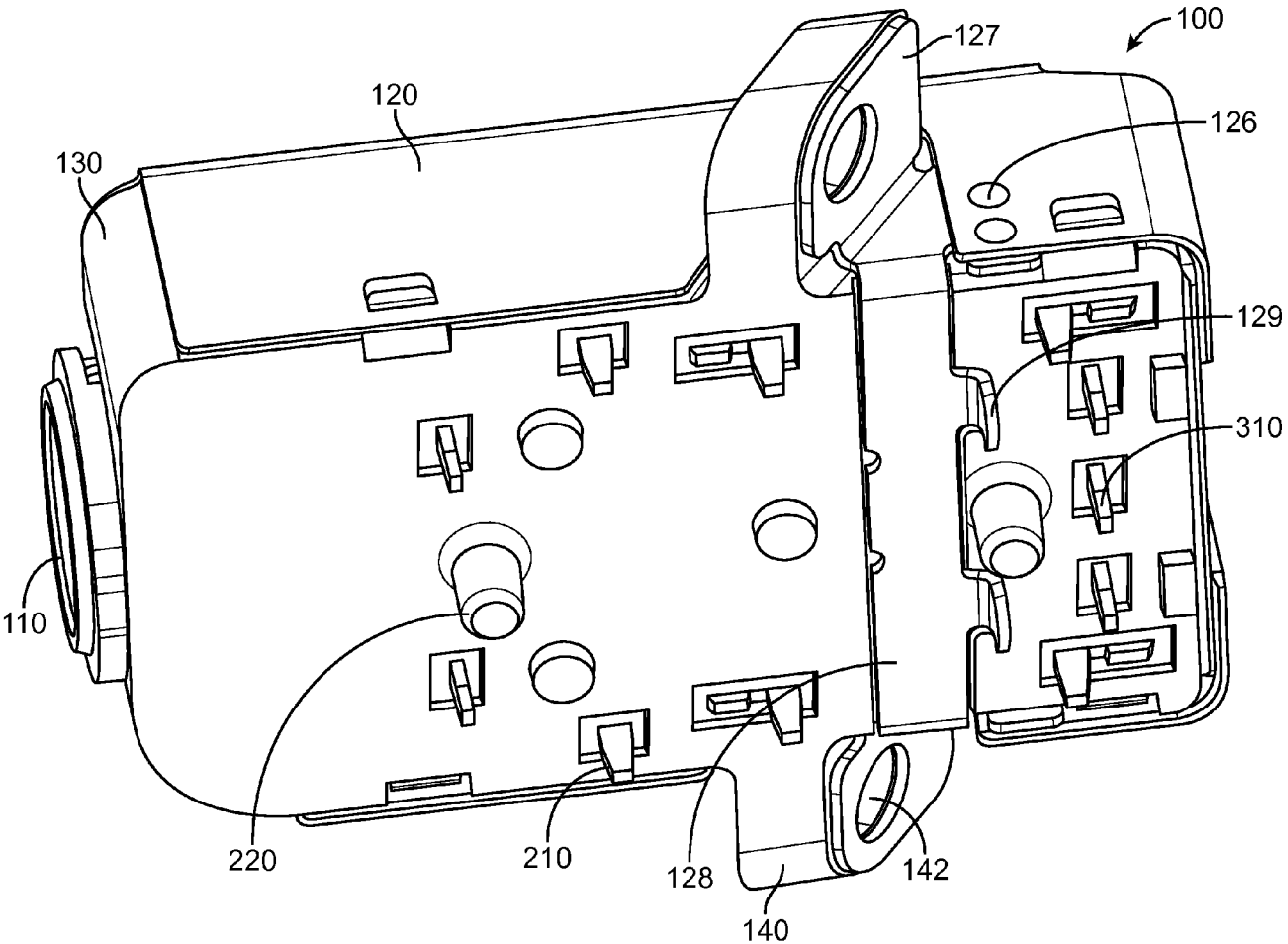
FIG. 3 illustrates an underside view of an audio jack according to an embodiment of the present invention.

FIG. 3 illustrates an underside view of an audio jack according to an embodiment of the present invention. As before, audio jack 100 may include housing 130 having a front opening 110. Posts 220 may be used to mechanically align and secure audio jack 100 to a main-logic board. Flanges 140 may have openings 142 to accept fasteners to a bracket or other structure which may be attached to a main-logic board, device enclosure, or other appropriate substrate. Again, through-hole contact portions 210 may be inserted into openings on a main logic board or other substrate to form an electrical connection to circuitry on the main-logic board or elsewhere in the electronic device housing audio jack 100. Contacts 310 may be used to connect terminals of a light admitting diode module inside audio jack 100 to circuitry on the main-logic board or other locations in the device.

Shell portion 127 may be placed under flanges 140 and may include crosspiece 128 running under audio jack 100. Crosspiece 128 may include tabs 129 for ground connections to the main-logic board. Shell portion 127 may connect to the other portions of shell 128 at points 126. Points 126 may be laser or spot welded, or fixed together in some other manner.

Figure 4:
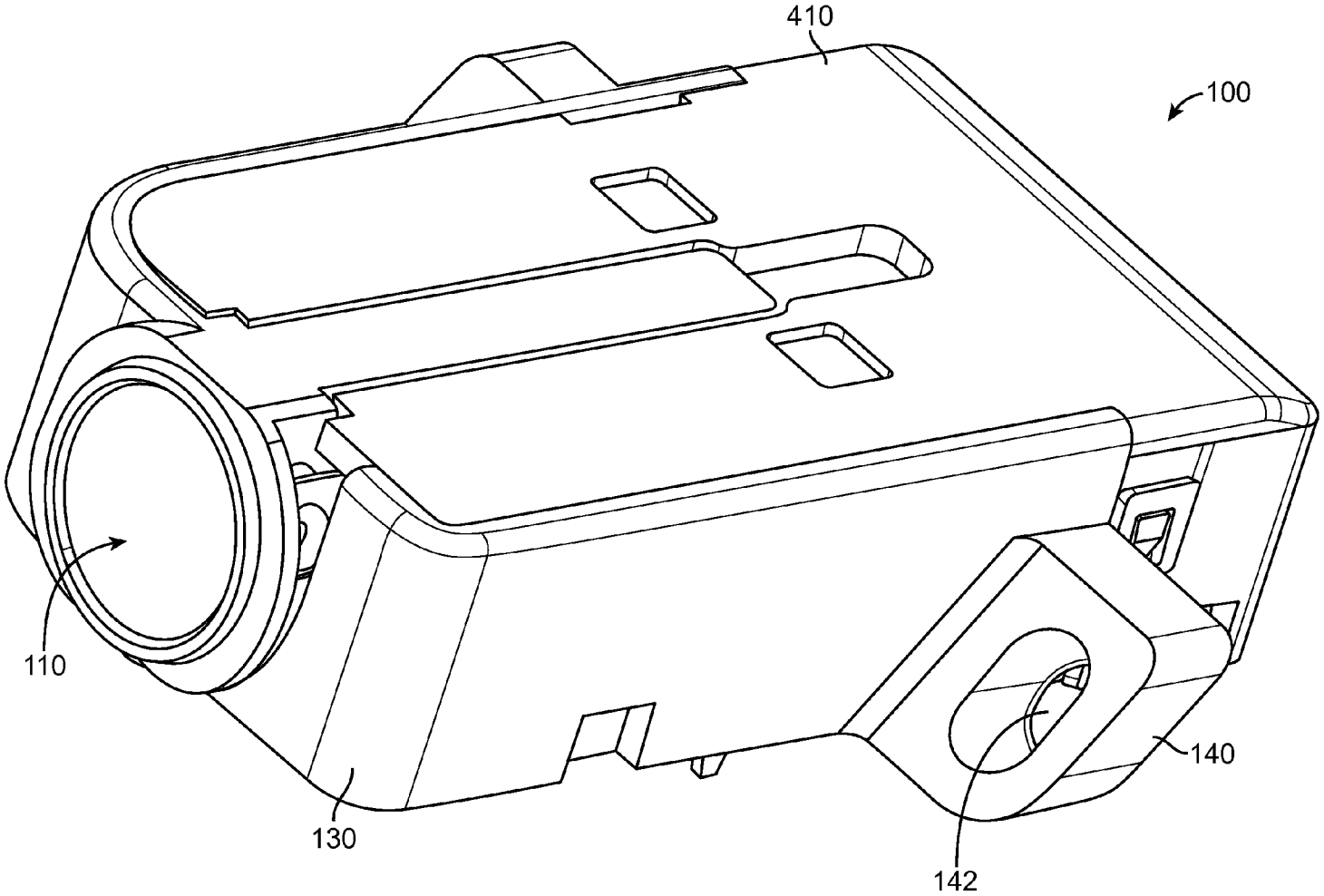
FIG. 4 illustrates a top oblique view of an audio jack where a shell portion has been removed.

FIG. 4 illustrates a top oblique view of an audio jack where a shell portion has been removed. Again, housing 130 may have flanges 140, each having openings 142. Housing 130 may have a front opening 110. Housing 130 may be covered by a non-conductive cover 410. Nonconductive cover 410 may electrically isolates contacts inside audio jack 100 from shell 120.

Figure 5:
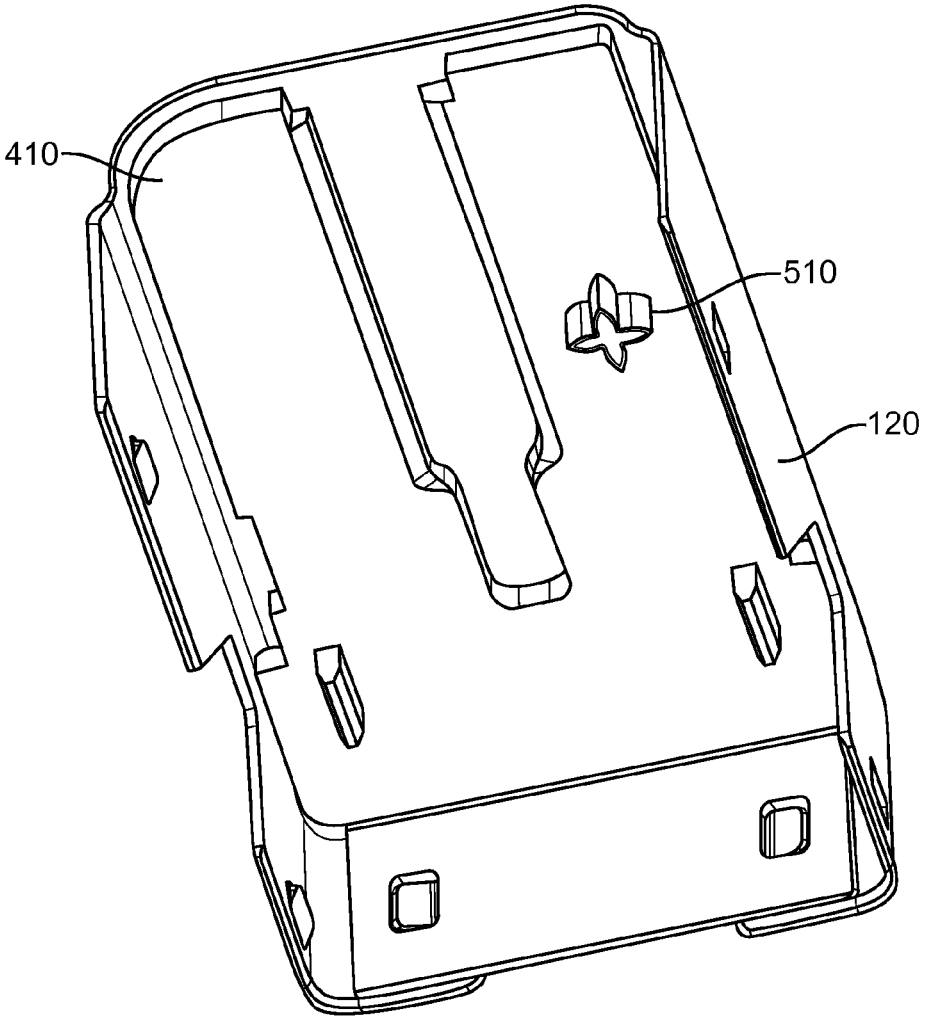
FIG. 5 illustrates an underside view of shell 120 and cover 410. Cover 410 may include alignment key 510.

FIG. 5 illustrates an underside view of shell 120 and cover 410. Cover 410 may include alignment key 510. Alignment key 510 may fit in a corresponding opening in housing 130, as shown below.

Figure 6:
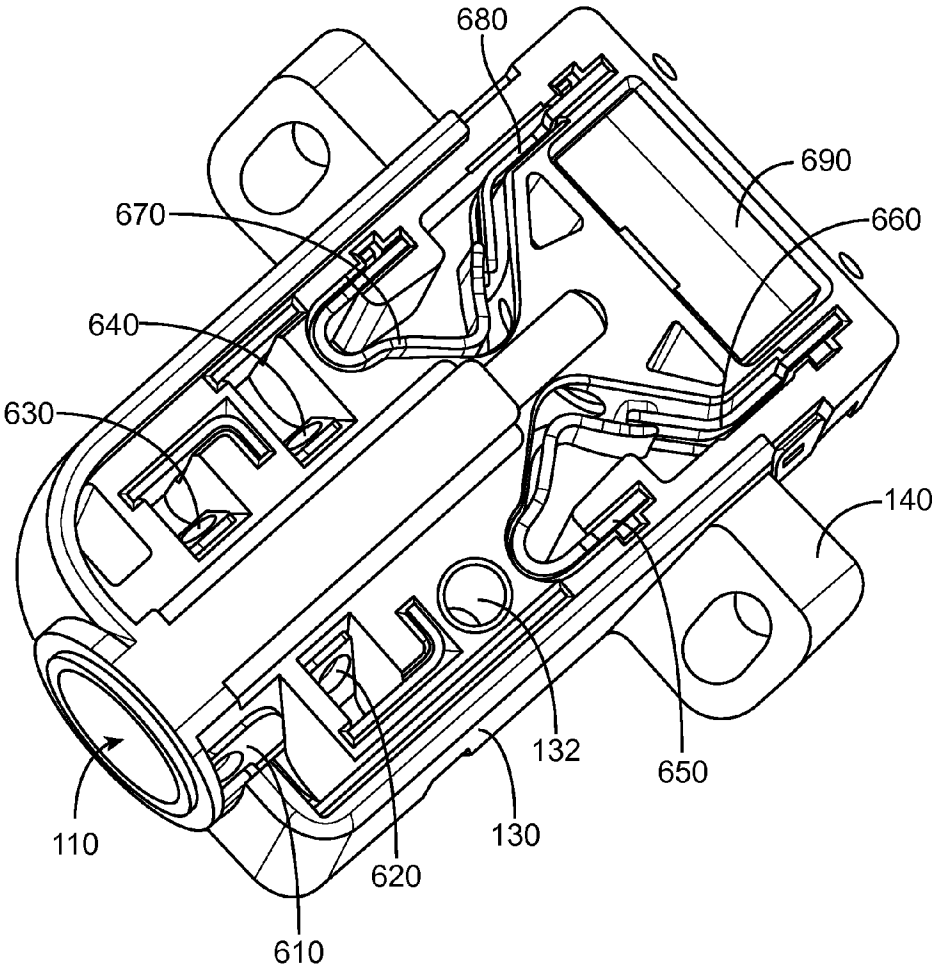
FIG. 6 illustrates a top view of an audio jack where a shell and a cover have been removed.

FIG. 6 illustrates a top view of an audio jack where a shell and a cover have been removed. Specifically, shell 120 and cover 410 have been removed from audio jack 100. Housing 130 may include a central passage having a front opening 110. A second opening the back end of the passage may allow access to light emitting module 690. It is at this second opening that light-emitting diode module 690 may provide a signal to an optical audio plug. Light-emitting module 690 may connect to circuitry on a main-logic board or other substrate via pins 310, as shown above. The central passage may include a number of side openings to allow contacts in audio jack 100 to form electrical or mechanical connections to an audio plug inserted in audio jack 100.

Specifically, audio jack 100 may include first contact 610, and second contact 620 on a first side of the passage. Opening 132 may accept alignment key 510 on cover 410. A first mechanical detect switch may include a first contacting portion 650 and a second contacting portion 660 on a first side of the passage. Third contact 630 may be oppositely positioned on a second side of the passage across the passage from second contact 620. A fourth contact 640 may be positioned between third contact 630 and a second detect switch, and may reside on the second side of the passage. The fourth contact may be located alternately on the first side of the passage along with the first and second contacts. The second detect switch may be formed of a first contacting portion 670 and a second contacting portion 680. As before, housing 130 may include flanges 140. These contacts and detect switches may be formed of various materials such as phosphor bronze, copper, stainless steel, tungsten, titanium tungsten, or other appropriate material. In various embodiments of the present invention, the mechanical detect switches, which need to deflect a fair amount, are made of a different material than the other contacts, which do not deflect as much. The contacts and detect switches themselves are shown in greater detail in the following figures.

Figure 7:
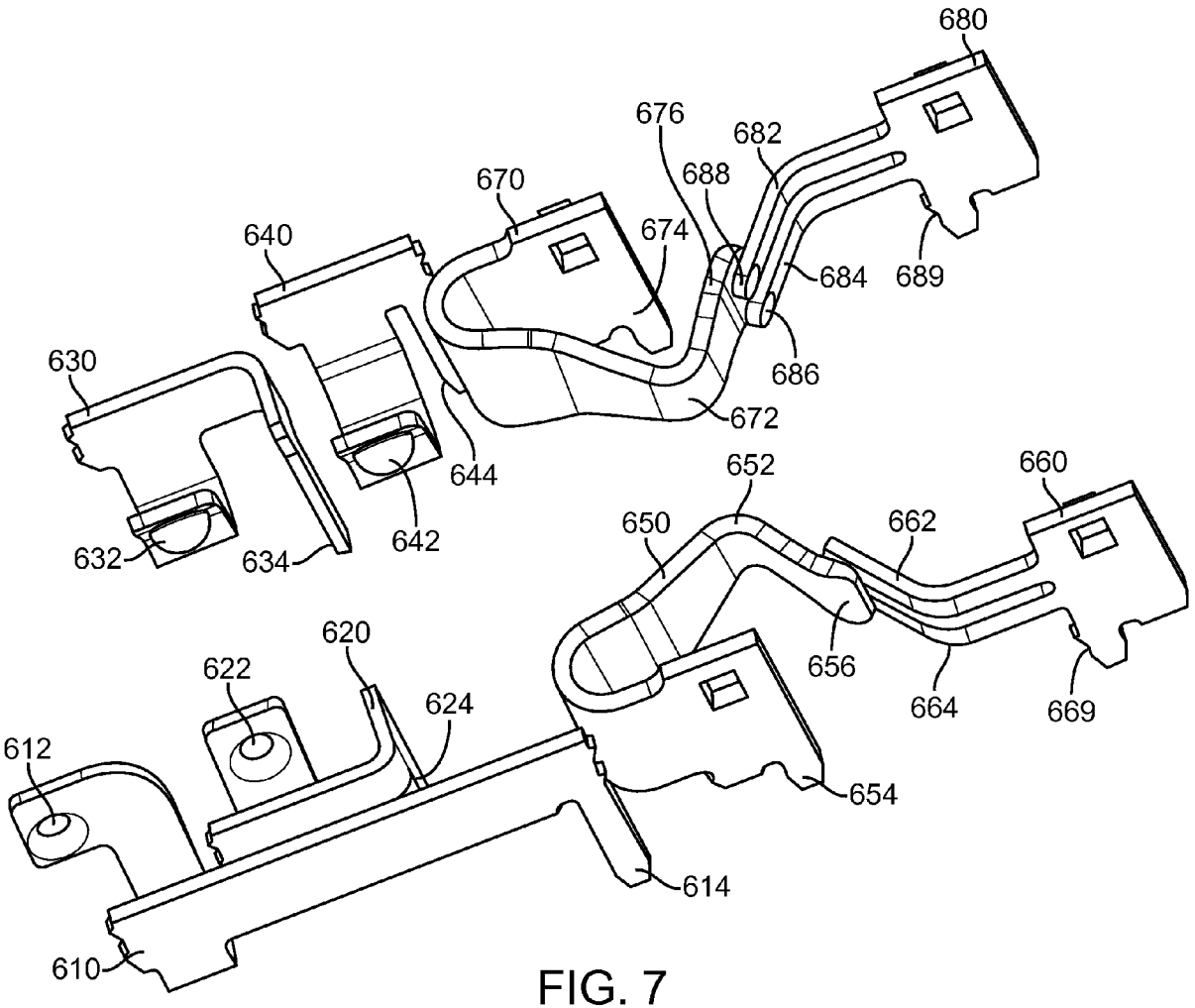
FIG. 7 illustrates a number of contacts and mechanical detect switches according to an embodiment of the present invention.

FIG. 7 illustrates a number of contacts and mechanical detect switches according to an embodiment of the present invention. First contact 610 is included. First contact 610 may include a contacting portion 612 to contact a corresponding metal contact on an electrical audio plug. Contacting portion 612, as with the contacting portions on the other contacts, may have a raised or dimpled portion. This raised or dimpled portion may improve contact to the audio plug, and may reduce marring and wear of the audio plug and contacts 610. Contact 610 may further include a through-hole contacting portion 614. Through-hole contacting portions such as through-hole contact portion 614 may be contacts generically shown as contacts 210 in FIG. 3. These through-hole contact portions may be other types of contacting portions in other embodiments of the present invention. For example, they may be surface mount or other types of contacts. Contact 610 may commonly be used to form an electrical connection with a microphone contact on an audio plug. Some electrical audio plugs however may use this contact as a ground, in which case contact 610 may be a ground contact.

Audio jack 100 may further include second contact 620. Second contact 620 may be located away from a front of audio jack 100 behind first contact 610 and may include contacting portion 622 and through-hole contacting portion 624. Second contact 620 may be a ground contact to electrically connect to a ground contact on audio plug. Some electrical audio plugs however may use this contact as a microphone contact, in which case contact 610 may be a microphone contact.

Third contact 630 may be located approximately directly opposite second contacts 620. Third contact 630 may include contacting portion 632 and through-hole contact portion 634. Third contact 630 may also be a ground contact or a microphone contact. When an electrical audio plug is inserted, an electrical connection may be formed between second contact 620 and third contact 630. Circuitry may detect this connection and the presence of an electrical audio plug may therefore be determined.

Fourth contact 640 may be located behind third contact 630 and may include contacting portion 640 and through-hole portion 644. Fourth contact 640 may be a right audio contact.

First contact 610 and second contacts 620 may be located on a first side passageway where the passageway accepts an audio plug. A first detect switch may be located behind second contacts 620 and located on the first side of the passage. First detect switch may include a first contacting portion 650 and a second contacting portion 660. First contacting portion 650 may include through-hole portion 654, an inflection or contact point 652 to make physical contact with an audio plug, and a surface portion 656. Second contacting portion 660 may include a through-hole portion 669, and two or more arms 662 and 664. These multiple arms may contact surface portion 656 of the first contacting portion 650.

A second detect switch may be located in a second side of the passage behind fourth contact 640. The second detect switch may include a first contacting portion 670 and a second contacting portion 680. First contacting portion 670 may include through-hole portion 672 and inflection or contacting point 672. Contacting point 672 may make physical contact with an audio plug as it is inserted. Second contacting portion 680 may include through-hole portion 689 and one or more arms 682 and 684. These arms may contact the surface portion 676 of the first contacting portion 670 at contact points 686 and 688. The first and second mechanical detect switches may double as left audio channel contacts. These mechanical detect switches thus may be located in the central passage furthest from the opening in the front of the audio jack. The mechanical detect switches may be used to activate an audio signal. In this way, circuitry associated with the audio jack may activate the audio signal only after it detects the insertion of an audio plug, thus avoiding the electrical noise that may occur during the insertion of an audio plug if a signal is present at all times.

Again, dust and debris may enter audio jack 100 at opening 110. This dust and debris may become lodged in the detect switches, thereby forcing them to an open position even when an audio plug is not inserted. Specifically, dust or debris may become lodged between arms 682 and 684 of second contacting portion 680, thereby preventing contact points 686 and 688 from contacting first contacting portion 670.

Accordingly, embodiments of the present invention may employ one or more levels of redundancy to ensure an accurate detection of the presence of an audio plug in audio jack 100. The first level of redundancy may be the inclusion of more than one mechanical detection switch. In this example, two mechanical detect switches are used. Secondly, more than one contact point between the first contacting portion second contacting portion of the mechanical switches may be used. In this example, two arms, each having two contact points, are used for each mechanical detect switch.

Despite this, dust and debris may still become lodged in these mechanical detect switches. Accordingly, the first contacting portion and the second contacting portions of these mechanical detect switches may be biased such that they remain in contact with each other as an audio plug begins to be inserted into audio jack 100. Specifically, arms 682 and 684 may be biased against surface portion 676, and surface portion 676 may be biased against arms 682 and 684. As contact point 672 contacts an audio plug, contact point 672 may be depressed and surface portion 676 may follow. For some time however, contact between arms 682 and 684 and surface portion 676 may remain. This extended contact may lead to the wiping of contact points 686 and 688 across surface portion 676. This wiping action may help to dislodge or remove debris thereby improving device performance.

By using two ground contacts and two detect switches, a reliable manner of detecting the presence of electrical and optical audio plugs may be achieved. For example, if only one detect switch is closed, it is likely that no audio plug is present and dust or debris is keeping the open switch open. Of course if both are open, an audio plug is likely present, and if both are closed, no jack is present. Once the presence of a jack is determined, it may be determined whether an electrical path between second contact 620 and third contact 630 exists. Examples of circuits that may be used for this may be found in co-pending U.S. patent application Ser. No. 12/894,587, titled AUDIO JACK WITH GROUND DETECT, filed Sep. 30, 2010. by Gao, which is incorporated by reference. If an electrical path between the two ground contacts does exist, then an electrical audio plug is likely present, if not, an optical audio plug is likely present. When an optical audio plug is likely present, light-emitting diode module 690 may be powered up. In other embodiments of the present invention, other algorithms for determining the presence of an audio plug may be used. For example, anytime an electrical path between second contact 620 and third contact 630 exists, it may be determined that an electrical audio plug is likely present, independent of the status of the mechanical detect switches.

Again, many audio jacks 100 may need to be manufactured for a popular device. Accordingly, embodiments of the present invention may provide audio jacks that are readily assembled. Specifically, the contacts and switches shown in FIG. 7 may be inserted into contact positions in housing 130, as is shown in FIG. 6. Cover 410 may be placed over a top of housing 130. Again, alignment key 510 may be inserted into opening 132 in housing 130. Shell 120 and shell piece 128 may be attached around the body of audio jack 100.

Figure 8:
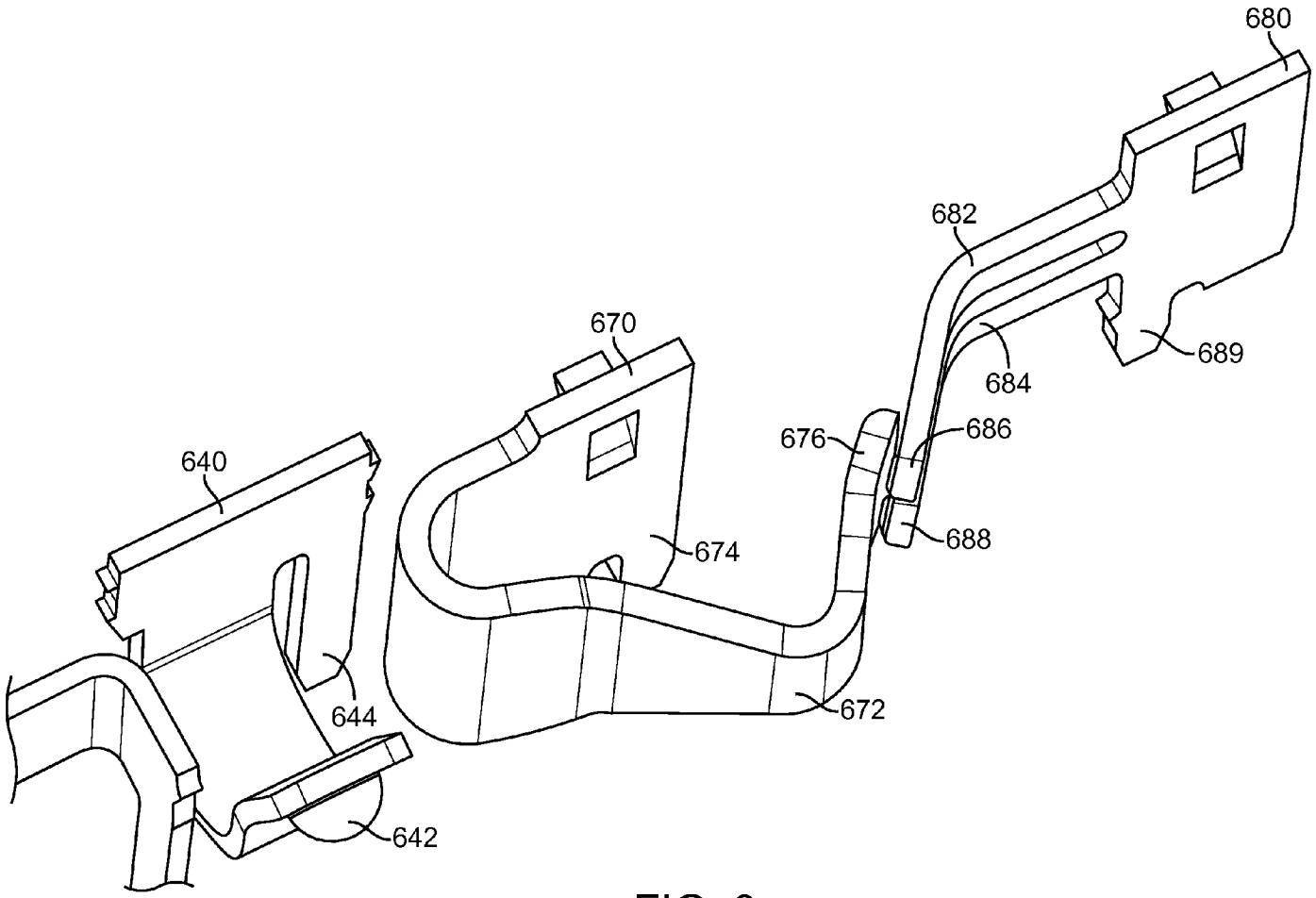
FIG. 8 illustrates a close-up view of a fourth contact and a second detect switch according to an embodiment of the present invention.

FIG. 8 illustrates a close-up view of a fourth contact and a second detect switch according to an embodiment of the present invention. Fourth contact 640 may include through-hole contacting portion 644 and contacting portion 642. Contacting portion 642 may be raised or dimpled as described above. Contacting portion may come into contact with a contact on an audio plug when an audio plug is inserted into audio jack 100.

Second detect switch may include a first contacting portion 670 and second contact portion 680. First contacting portion 670 may include through-hole contacting portion 674, physical contacting point 672 and surface portion 676. Second contacting portion 680 may include arms 682 and 684 and through hole portions 689. Arms 682 and 684 may terminate at contacting points 686 and 688. Contacting portions 686 and 688 may form electrical contact with surface portion 676 of first contacting portion 670.

Figure 9:
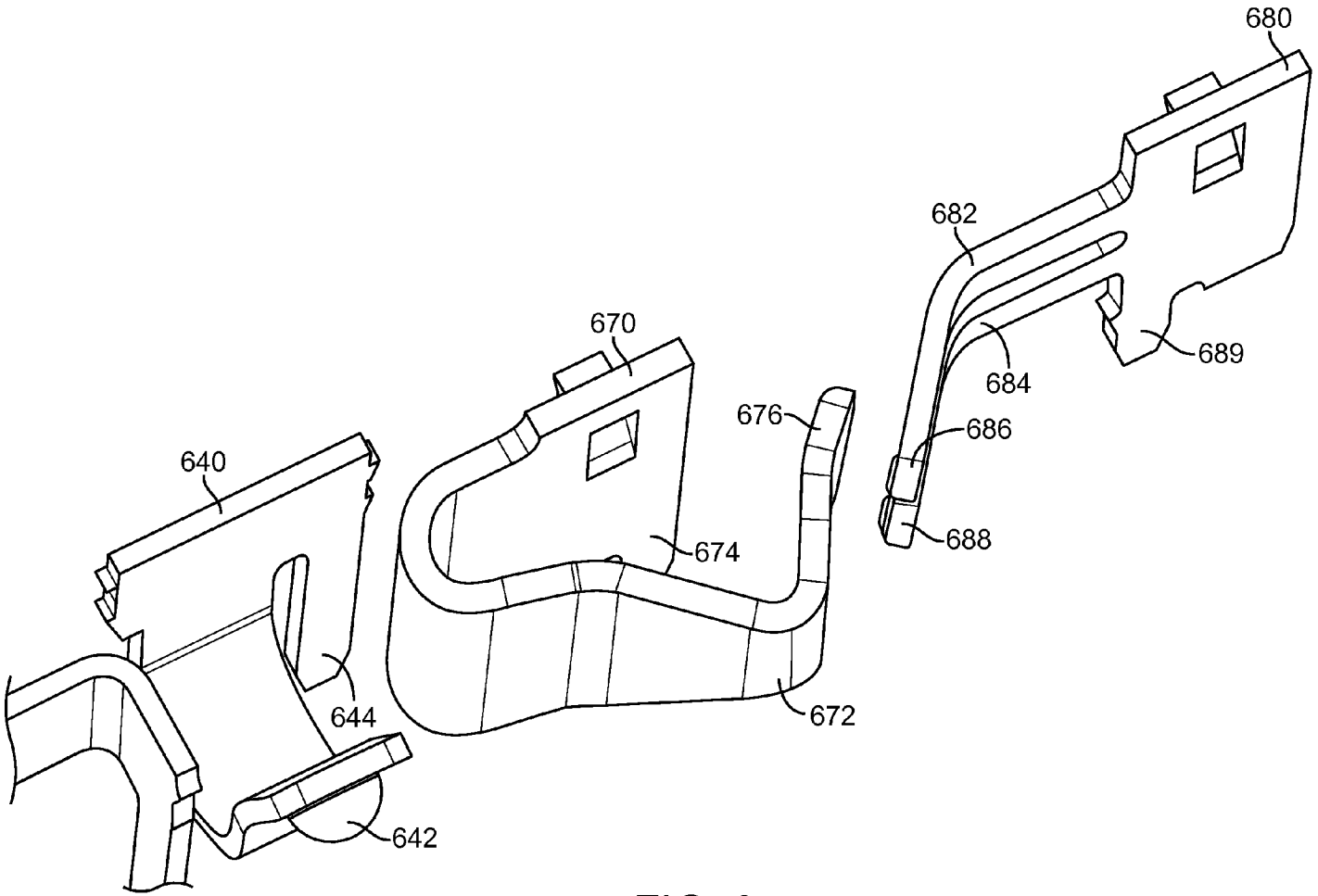
FIG. 9 illustrates a close-up view the contacting portion of the second detect switch of FIG. 8 being depressed by the insertion of an audio plug.

FIG. 9 illustrates a close-up view the contacting portion of the second detect switch of FIG. 8 being depressed by the presence of an audio plug. Specifically physical contacting point 672 may be depressed by the presence of an audio plug (not shown.) As physical contacting point 672 is depressed by the presence of an audio plug, the first contacting portion 676 may wipe across the second contacting portion made up of arms 686 and 688.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. An audio jack comprising:

a housing having a passage, the passage forming a front opening in the housing;

a first contact on a first side of the passage near the front opening;

a second contact on the first side of the passage behind the first contact;

a third contact on a second side of the passage across from the second contact;

a first detect switch on the first side of the passage behind the second contact; the first detect switch comprising a first contacting portion biased against a second contacting portion, the second contacting portion including a first arm and a second arm to contact the first contacting portion; and a second detect switch on the second side of the passage behind the third contact.

2. The audio jack of claim 1 further comprising a fourth contact between the third contact and the second detect switch.

3. The audio jack of claim 1 further comprising a fourth contact between the second contact and the first detect switch.

4. The audio jack of claim 1 wherein the second detect switch comprises a first contacting portion biased against a second contacting portion, the second contacting portion including a first arm and a second arm to contact the first contacting portion.

5. The audio jack of claim 1 wherein the first contacting portion is biased again the second contacting portion such that when the first contacting portion is depressed by the presence of an audio plug, the first contacting portion wipes across the second contacting portion.

6. The audio jack of claim 1 wherein the first contacting portion is biased again the second contacting portion and the second contacting portion is biased against the first contacting portion such that when the first contacting portion is depressed by the presence of an audio plug, the first contacting portion wipes across the second contacting portion.

7. The audio jack of claim 1 wherein the second contact and the third contact are ground contacts.

8. The audio jack of claim 1 further comprising a light-emitting diode module behind the first detect switch and the second detect switch.

9. An audio jack comprising:

a housing having a passage, the passage forming a front opening in the housing;

a first contact on a first side of the passage near the front opening;

a second contact on the first side of the passage behind the first contact;

a first detect switch on the first side of the passage behind the second contact; the first detect switch comprising a first contacting portion biased against a second contacting portion, the second contacting portion including a first arm and a second arm to contact the first contacting portion;

a second detect switch on a second side of the passage, the second side of the passage being across the passage from the first side of the passage; and a light emitting diode module behind the first detect switch and the second detect switch.

10. The audio jack of claim 9 further comprising a third contact on a second side of the passage across from the second contact.

11. The audio jack of claim 10 further comprising a fourth contact between the third contact and the second detect switch.

12. The audio jack of claim 10 further comprising a fourth contact between the second contact and the first detect switch.

13. The audio jack of claim 10 wherein the second contact and the third contact are ground contacts.

14. The audio jack of claim 9 wherein the first contacting portion is biased again the second contacting portion such that when the first contacting portion is depressed by the presence of an audio plug, the first contacting portion wipes across the second contacting portion.

15. The audio jack of claim 9 wherein the first contacting portion is biased against the second contacting portion and the second contacting portion is biased against the first contacting portion such that when the first contacting portion is depressed by the presence of an audio plug, the first contacting portion wipes across the second contacting portion.

16. A method of assembling an audio jack comprising:

forming a housing having a central passage, the passage forming a front opening in the housing, the passage further having openings to expose portions of contacts, the openings leading to positions for contacts, the passage having a rear opening to expose a light-emitting diode module;

inserting a first contact in a first position on a first side of the passage near the front opening;

inserting a second contact in a second position on the first side of the passage behind the first contact;

inserting a third contact in a third position on a second side of the passage across from the second contact;

inserting a first detect switch in a fourth position on the first side of the passage behind the second contact; the first detect switch comprising a first contacting portion biased against a second contacting portion, the second contacting portion including a first arm and a second arm to contact the first contacting portion; and inserting a second detect switch in a fifth position on the second side of the passage behind the third contact.

17. The method of claim 16 further comprising inserting a light-emitting diode module behind the first detect switch and the second detect switch.

18. The method of claim 16 further comprising inserting a fourth contact in a sixth position between the third contact and the second detect switch.

19. The method of claim 16 further comprising inserting a fourth contact in a sixth position between the second contact and the first detect switch.

20. The method of claim 16 further comprising covering the contacts with a conductive covering.

21. The method of claim 20 further comprising covering a top of the receptacle with a conductive shell.

* * * * *